US005341530A

United States Patent [19]

Ward

[11] Patent Number: 5,341,530

[45] Date of Patent: Aug. 30, 1994

[54] INFLATABLE CRIB WITH CARRYING STRAPS

[76] Inventor: Raymond Ward, 13430 N. 2nd St., Phoenix, Ariz. 85022

[21] Appl. No.: 62,275

[22] Filed: May 17, 1993

[51] Int. Cl.[5] ..... A47D 13/02; A47D 7/00

[52] U.S. Cl. ..... 5/93.1; 5/94; 5/414; 5/416; 5/655; 383/3; 383/18

[58] Field of Search ..... 5/93.1, 94, 414, 416, 5/424, 449, 455, 655; 224/158; 383/3, 18

[56] References Cited

U.S. PATENT DOCUMENTS 2,908,020 10/1959 Barton ..... 5/99.1
3,323,147 6/1967 Van Dean ..... 5/98.1
3,513,489 5/1970 Miller et al. ..... 5/94
3,619,825 11/1971 Taub et al. ..... 5/97
4,003,098 1/1977 Fink ..... 5/93.1
4,104,750 8/1978 Kelter et al. ..... 5/93.1
4,827,542 5/1989 Kurtenbach ..... 5/93.1

*Primary Examiner*—Alexander Grosz

[57] ABSTRACT

An inflatable crib permits the safe, comfortable transport of an infant, while the crib is inflated, and requires minimal storage space when deflated. Carrying straps provide load bearing support to the cradle base on which a child is carried. An inflatable mattress adds to the child's comfort. A protective covering shields the child from sun, elements, and insects. The carrying straps have form retaining, self supporting first and second cross members extending above the crib and are adapted to releasable support the protective covering.

19 Claims, 1 Drawing Sheet

INFLATABLE CRIB WITH CARRYING STRAPS

BACKGROUND

1. Prior Art

This is a refiling of patent application Ser. No. 07/966,511, filed by the inventor herein on Oct. 26, 1992, now abandoned but made part hereof by reference.

2. Technical Field of the Invention

The invention relates to devices for cradling and transporting infants. In particular, the invention relates to an infant transporter that is conveniently stored when not in use. Specifically, the invention relates to an inflatable crib.

PRIOR BACKGROUND ART

The prior art is replete with apparatus designed to cradle and transport infants. Some comprise a pair of fixed walls with a support platform between. Occasionally, the support platform may be adjusted such that a child on the platform may be supported in a prone or a seated position.

Other devices comprise a cloth or plastic container having a metal exoskeleton to preserve the container's shape while a child rests on a small mattress within the container. Often the metal exoskeleton is a folding framework that can be collapsed for storage. The container itself has a fairly limited lifetime since it tends to wear at the points of contact with the metal parts of the framework.

Regardless of their actual construction, most prior art cradles, and the like, are not convenient to store. The box-like, fixed walls of some demand a large volume of storage space be dedicated to receiving the cradle. And, while those having a foldable metal frame require less space, the rigidity of the metal components of that frame, often inhibit storage in a space which at first appears ideally suited for such purpose.

Transporters with solid support platforms do not provide a support compliant enough to be comfortable for a child; while the support surface offered by a cloth or plastic container is too compliant for proper, comfortable support. As a result, mattresses and the like have to be provided with these prior art devices. Such additional items, with their padding, further complicate storage of the crib/cradle.

It is an object of the invention that an infant transporting device shall be derived, which is comfortable for a child being transported; and is suitable to permit an infant to sleep therein.

It is a further object, that the invention shall be easily stored, occupy a minimal volume of space, and, generally, conform to the shape of the storage space available for such minimum volume storage.

SUMMARY DESCRIPTION OF THE INVENTION

The invention is disclosed as an improvement in a cradle for transporting an infant and providing a place of comfortable repose for the infant. The cradle being improved has an enclosure with walls for encompassing the infant, and a base on which the infant is laid for rest and transport. The base is coupled to the walls of the enclosure. There are means coupled to the cradle for carrying the cradle while the infant is being transported therein.

In the improvement, the walls comprise an air impervious bladder. Means are coupled to the bladder for the selected entry and exit of air into and from the bladder. In this way, upon inflation with air, the bladder forms a resilient, soft enclosure for the infant, and, upon deflation of the bladder, the volume of the cradle is reduced for storage.

The base is a flexible fabric, the folding of which further reduces the storage volume of the cradle when the bladder is deflated. The means for carrying the cradle comprises form retaining, flexible strap means having a first cross member extending above the cradle, to be grasped for carrying, and further extending beneath the base as a first load bearing member to reinforce the base when the infant is placed on the base and transported by a person grasping the strap means.

The strap means further includes a second cross member, generally orthogonal to the first cross member, extending above the cradle for grasping and further extending beneath the base as a second load bearing member reinforcing the base.

The base itself is an air impervious fabric including an air bladder for resiliently stiffening the base when inflated, while providing a soft resting place for the infant. In a presently preferred embodiment, the air bladder in the fabric of the base comprises a plurality of individual air retaining compartments for functioning as stiffening ribs for the base when inflated.

Ideally, a protective covering is coupled to the cradle for shielding the infant placed in the cradle from the sun, elements, and insects. The protective covering is coupled to the form-retaining, flexible strap means.

For added comfort for the infant, an air inflatable mattress is removably emplaced within the enclosure and supported by the base. As disclosed, there are removable coupling means coupling the mattress to the base for removably maintaining the mattress in position on the base.

In addition, the air inflatable mattress comprises a plurality of individual air retaining compartments functioning as stiffening ribs for the mattress when inflated. The inflatable stiffening ribs for the mattress are relatively wider than the stiffening ribs for the base of the crib. Each of the stiffening ribs of the mattress overlap a plurality of the stiffening ribs of the crib's base when the base is supporting the mattress.

DETAILS OF BEST MODE FOR CARRYING OUT THE INVENTION

Figures 1, 2, 3, 4, 5, 6, 7, 8:
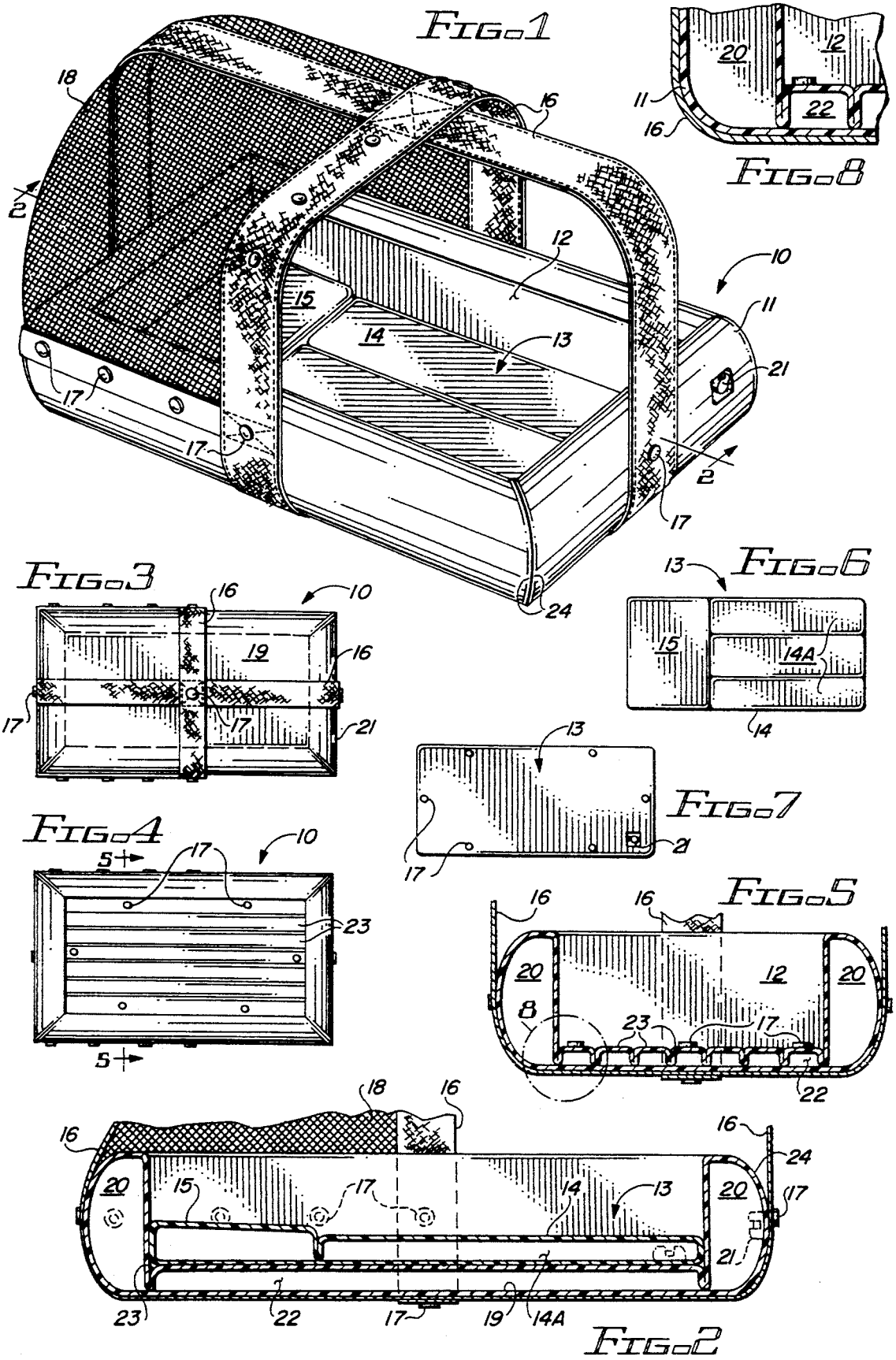
FIG. 1 is a perspective drawing of the inflatable crib showing straps as means for carrying and handling the crib, and a protective covering.
FIG. 2 is a side sectional view of the crib taken along lines 2—2 of FIG. 1. Inflatable rib stiffeners and an air mattress are readily seen in this view.
FIG. 3 is a bottom view of the crib.
FIG. 4 is a plan view of the interior of the crib. The mattress has been removed in this drawing.
FIG. 5 is an end sectional view taken along lines 5—5 of FIG. 4.
FIGS. 6 and 7 are top and bottom views, respectively, of the air mattress used with the invention.
FIG. 8 is a detail drawing of the of the area circled in FIG. 5.

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention pertains.

The inflatable crib 10, disclosed and claimed herein, is shown in FIG. 1. Details of its construction may be seen in FIGS. 2–8 to which reference should be made during the course of this disclosure. Crib 10 is an inflatable enclosure or frame 11 having end and side wall surfaces 24 which define inflatable bladder compartments 20, best seen in the sectional views of FIGS. 2, 5, and 8.

Rib walls 23, attached to crib bottom 19 define inflatable rib, stiffener bladder compartments 22. An air filler valve 21 serves as the port through which air enters to inflate wall and rib compartments 20 and 22, respectively. The same valve serves as an air egress port when deflating crib 10.

For simplicity of explanation, the structure here disclosed permits air to circulate through both wall and rib compartments 20 and 22. Multiple, isolated, individually inflated air bladder compartments are readily envisioned and implemented.

Wall and rib compartments 20 and 22 form an open topped enclosure 11 having an interior 12 into which an infant, not shown, may be placed for rest and/or transport. To add to the comfort of the child, a removable, inflatable insert 13 may be placed within the interior 12 of crib 10, to rest atop rib stiffener compartments 22. Insert 13 comprises a mattress 14 and a pillow 15, both being inflatable via another one of filler valves 21, which provides an air ingress and egress port, as earlier described. Pillow 15 has a somewhat greater inflated height than does mattress 14 to provide a child with greater, more comfortable head support. See FIG. 2.

A plurality of mating snap fasteners 17, within crib 10 (FIG. 4) and at the bottom of mattress 13 (FIG. 7), retain mattress 13 in stabile position within interior 12. Air inflatable mattress 14 comprises a plurality of individual air retaining compartments functioning as stiffening ribs 14A for the mattress when inflated. Stiffening ribs 14A, in the mattress, are relatively wider than the inflatable rib, stiffener bladder compartments 22 at bottom 19 of crib 10. Each of the stiffening ribs 14A of the mattress 14 overlap a plurality of stiffener bladder compartments 22 of the crib's bottom when the bottom is supporting the mattress.

At this point in the structural development of crib 10 it could well be used for an infant. However, the child's parent, or other person, would have to use both arms to safely carry crib 10 with the child inside. Further development will ease this situation.

Means for carrying crib 10 are provided by straps 16. Straps 16 are combined to form a cruciform shape when viewed from the top, as in FIG. 1, as well as from the bottom, as in FIG. 3. Again, a plurality of mating snap fasteners 17 are employed, this time to retain straps 16 in position when coupled to crib 10 by snap fasteners positioned on walls 24 and on bottom 19 of the crib. The cruciform arrangement at top and bottom, of straps 16, assures that crib 10 may be carried by means of these straps while providing orthogonal lines of support beneath the crib for the safe transport of a child within the crib.

Preferably, straps 16 are fabricated of a material having a shape retaining memory so that the straps may be folded or rolled for storage with crib 10 when crib 10 is deflated. The ability of straps 16 to return to the self supported shape illustrated in FIG. 1, after being otherwise deformed for storage, permits straps 16 to stand away from making interfering contact with an infant placed within crib 10. A further advantage of such form retention is also derived.

Since straps 16 retain their shape and stand away from and above interior 12 of crib 10, they may be used to maintain a protective covering 18 above the crib to protect an infant therein. For example, in the illustrations of FIGS. 1 and 2, protective covering 18 is shown as a mosquito netting. Other protective coverings for shade, weather or insect protection are also conceived.

What has been disclosed is an inflatable crib which permits the safe, comfortable transport of an infant, while the crib is inflated, and which requires minimal storage space when deflated. Carrying straps provide load bearing support to the cradle base on which a child is carried. An inflatable mattress adds to the child's comfort. A protective covering shields the child from sun, elements, and insects. The carrying straps have form retaining, self supporting first and second cross members extending above the crib and are adapted to releasable support the protective covering.

Those skilled in the art will conceive of other embodiments of the invention which may be drawn from the disclosure herein. To the extent that such other embodiments are so drawn, it is intended that they shall fall within the gambit of protection provided by the claims herein.

Having described the invention in the foregoing description and drawings in such clear and concise manner that those skilled in the art may readily understand and practice the invention, that which is claimed is:

1. In a cradle for transporting an infant and providing a place of comfortable repose for said infant, said cradle comprising an enclosure with walls for encompassing said infant, a base on which said infant is laid for rest and transport, said base being coupled to said walls of said enclosure, and means coupled to said cradle for carrying said cradle while said infant is being transported therein, the improvement comprising:

said walls comprising an air impervious bladder;

means coupled to said bladder for the selected entry and exit of air into and from said bladder;

whereby, upon inflation with air, said bladder forms a resilient, soft enclosure for said infant, and, upon deflation of said bladder, the volume of said cradle is reduced for storage;

said means for carrying said cradle comprising form retaining, flexible strap means having a first cross member extending above said cradle, to be grasped for carrying, and further extending beneath said base as a first load bearing member to reinforce said base when said infant is placed on said base and transported by a person grasping said strap means; and said strap means further comprises a second cross member, generally orthogonal to said first cross member, extending above said cradle for grasping and further extending beneath said base as a second load bearing member reinforcing said base; said form retaining, flexible strap means adapted to be folded or rolled for storage when the cradle is deflated, and upon inflation of the cradle, the first and second cross member portions of the strap means adapted to be configured in a self supported configuration above the cradle, standing away from making interfering contact with an infant resting in the cradle, whereby a protective covering means may be supported on said self supported straps means to thereby shield the infant.

2. The improvement of claim 1 wherein said base comprises a flexible fabric, the folding of which further reduces the storage volume of said cradle when said bladder is deflated.

3. The improvement of claim 2 wherein said fabric of said base is an air impervious fabric including an air bladder for resiliently stiffening said base when inflated while providing a soft resting place for said infant.

4. The improvement of claim 3 said air bladder in said fabric of said base comprising a plurality of individual air retaining compartments for functioning as stiffening ribs for said base when inflated.

5. The improvement of claim 4 further comprising protective covering means coupled to said cradle for shielding said infant placed in said cradle from at least one of sun, elements, and insects.

6. The improvement of claim 5 wherein said protective covering means is coupled to said form-retaining, flexible strap means.

7. The improvement of claim 4 further comprising an air inflatable mattress removably emplaced within said enclosure and supported by said base.

8. The improvement of claim 7 further comprising removable coupling means coupling said mattress to said base for removably maintaining said mattress in position on said base.

9. The improvement of claim 7 wherein said air inflatable mattress comprises a plurality of individual air retaining compartments functioning as stiffening ribs for said mattress when said mattress is inflated, said stiffening ribs for said mattress being relatively wider than said stiffening ribs for said base, each said stiffening rib of said mattress overlapping a plurality of said stiffening ribs of said base when said base is supporting said mattress.

10. The improvement of claim 9 further comprising protective covering means coupled to said cradle for shielding said infant placed in said cradle from at least one of sun, elements, and insects.

11. The improvement of claim 1 wherein said fabric of said base is an air impervious fabric including an air bladder for resiliently stiffening said base when inflated while providing a soft resting place for said infant.

12. The improvement of claim 11 said air bladder in said fabric of said base comprising a plurality of individual air retaining compartments for functioning as stiffening ribs for said base when inflated.

13. The improvement of claim 12 further comprising protective covering means coupled to said cradle for shielding said infant placed in said cradle from at least one of sun, elements, and insects.

14. The improvement of claim 12 further comprising an air inflatable mattress removably emplaced within said enclosure and supported by said base.

15. The improvement of claim 14 wherein said air inflatable mattress comprises a plurality of individual air retaining compartments functioning as stiffening ribs for said mattress when said mattress is inflated, said stiffening ribs for said mattress being relatively wider than said stiffening ribs for said base, each said stiffening rib of said mattress overlapping a plurality of said stiffening ribs of said base when said base is supporting said mattress.

16. The improvement of claim 1 further comprising protective covering means coupled to said cradle for shielding said infant placed in said cradle from at least one of sun, elements, and insects.

17. The improvement of claim 16 wherein said protective covering means is coupled to said form-retaining, flexible strap means.

18. The improvement of claim 1 further comprising an air inflatable mattress removably emplaced within said enclosure and supported by said base.

19. The improvement of claim 18 further comprising removable coupling means coupling said mattress to said base for removably maintaining said mattress in position on said base.

* * * * *